United States Patent [19]

Shelton et al.

[11] Patent Number: 4,614,272

[45] Date of Patent: Sep. 30, 1986

[54] COMMODITY DISPLAY DEVICE

[75] Inventors: Robert N. Shelton, Leominster, Mass.; Gail S. Mowrer, Nashua, N.H.

[73] Assignee: Foster Grant Corporation, Leominster, Mass.

[21] Appl. No.: 606,799

[22] Filed: May 3, 1984

[51] Int. Cl.[4] ..... A47F 5/02

[52] U.S. Cl. ..... 211/163; 211/13; 211/131; 16/317; 248/DIG. 2

[58] Field of Search ..... 211/163, 13, 129, 131, 211/144; 16/318, 317; 248/DIG. 2, 145, 289.3

[56] References Cited

U.S. PATENT DOCUMENTS

| | | | |
|---|---|---|---|
| 219,921 | 9/1879 | Davis | 211/163 X |
| 1,049,072 | 12/1912 | Frey | 16/317 |
| 2,808,941 | 10/1957 | Foster | 211/13 |
| 2,816,666 | 12/1957 | Nadel | 211/163 X |
| 3,195,736 | 7/1965 | Bomar, Jr. | 211/163 |
| 3,357,568 | 12/1967 | Leblanc et al. | 211/163 X |
| 3,611,666 | 10/1971 | Poyser et al. | 52/731 |
| 3,844,230 | 10/1974 | Hudson et al. | 211/163 X |
| 3,868,156 | 2/1975 | Vander Ley | 16/318 X |
| 3,891,092 | 6/1975 | Surrette et al. | 211/163 X |
| 4,126,366 | 11/1978 | Hadler et al. | 211/163 X |

FOREIGN PATENT DOCUMENTS

| | | | |
|---|---|---|---|
| 1385605 | 12/1964 | France | 211/13 |
| 2262839 | 9/1975 | France | 211/13 |
| 234997 | 6/1925 | United Kingdom | 211/163 |

*Primary Examiner*—Robert W. Gibson, Jr.
*Assistant Examiner*—Blair M. Johnson
*Attorney, Agent, or Firm*—Hugh C. Crall; Tatsuya Ikeda

[57] ABSTRACT

There is described an article of manufacture adapted to the display of small commodities such as sunglasses in a convenient and esthetic manner. The commodity display device comprises one or more two-sided columns each of which comprising a box-like outer part comprising twin parts, an S-shaped column insert adapted to be positioned inside said box-like outer part and a column support device adapted to rotatably support said one or more columns in one or more levels and reposition said one or more columns to predetermined positions at rest. In a preferred embodiment, upper and lower vertical shafts extend from the top and bottom portions of each column, each lower vertical shaft has a V-shaped profile at the end portion thereof. In a preferred embodiment a suitable number of columns, for instance six, are arranged on the same level within the supporting device and one or more levels of columns may be provided in the column support device. The S-shaped column insert as combined with outer part of the rotatable column allows the sunglasses to be displayed back to back with temples extended in an esthetic manner without taking up a lot of display space.

30 Claims, 5 Drawing Figures

COMMODITY DISPLAY DEVICE

BACKGROUND OF THE INVENTION

The present invention relates to a novel display device for small commodities such as sunglasses. More specifically this invention relates to a display device comprising one or more two sided rotatable columns each of which have a box-like outer part comprising twin parts, an S-shaped column insert adapted to be positioned inside said box-like outer part and a column support device adapted to rotatably support said one or more columns in one or more levels and reposition said one or more columns to predetermined positions at rest.

Various sunglass display devices have been used in the past. A substantial portion of the prior art devices support sunglasses in a configuration where the temple portions are closed. It has been our experience, however, that from the retail standpoint it is preferable to have the temple portions open while the sunglasses are displayed, because, the sunglasses being a fashion item, the temple portions have an important effect upon the overall appearance. It is cumbersome from the standpoint of the purchaser to take up a pair of sunglasses from a display rack, open the temples, inspect the sunglasses, close the temples and put the pair back into the display rack. It is very difficult to do the whole procedure with one hand and obviously it takes some time. After the purchaser goes through several of such procedures a mental fatigue or frustration starts to set in the mind of the purchaser, which is very detrimental to the sale of sunglasses.

In another type of sunglass display devices the sunglasses are displayed in a configuration where the temple portions are open, but the end portions of the temples rest in holes provided in the display device. Therefore, in order for the purchaser to put the sunglasses back into the display rack after inspection, the purchaser has to find the two holes into which the end portions of the temples have to be inserted. This process of finding the holes in order to rest the sunglasses at the right position is again cumbersome and hence is a disadvantage for retail purposes.

Needless to say, since the retail space in any given store is limited, it is desirable to have a sunglass display device which can accommodate a large number of sunglasses within a given space without creating a crowded impression or visual confusion between individual pairs of sunglasses.

It will be appreciated that it is desirable that the display device have a flexibility or capability to accommodate a variable number of display columns. This is true because suitable or desired number of commodities to be displayed varies from store to store and because it may also vary from season to season within a given store. It will also be appreciated that from the standpoint of a manufacturer of commodity display devices, it is desirable that various parts be common to several or many variations of the display device.

Needless to say, where a plurality of columns are arranged together within a display device, it is desirable that they be arranged in a coherent manner with respect to each other rather than in a random manner so that the overall appearence of the displayed commodities may be esthetic all the time. Thus, it is very desirable to have a means adapted for repositioning each column at rest so that each column is locked to a certain orientation with respect to other columns when it is resting at a stable position even though it is rotatable during the inspection of the commodities by the purchaser.

Thus, an object of this invention is to provide a commodity display device particularly useful for sunglasses which can accommodate a large number of sunglasses within a limited amount of space and which can display them in an esthetic manner without creating a crowded impression or visual confusion between individual pairs of sunglasses. Another important object of this invention is to provide a display device particularly useful for displaying sunglasses such that, for at least a substantial portion and preferably all of the sunglasses on display, a temple member of the sunglass frame is visible to the purchaser when the frame is resting on the display device. Another object of this invention is to provide a display device such that the sunglass frame can be removed from and put back to the display device easily with one hand. Still another object of this invention is to provide a display device comprising one or more two-sided rotatable "columns" having a means adapted for reposition the orientations thereof at rest. The term "column" as used in this invention is a display unit to be maintained substantially vertically in the display device which can accommodate one or more sunglass frames in each of a plurality of rows provided on the front and back faces thereof. Still another object of this invention is to provide, as a preferred embodiment of the invention, a display device which can accommodate display columns in more than one level. Other objects of this invention will become apparent from the description of this invention presented below.

Thus, according to the present invention, a display device is provided which allows sunglasses to be displayed with temples extended in an esthetic manner without taking up a lot of display space.

The present invention will be described below with a particular emphasis upon the display of sunglasses. However, it will be apparent that the applications of this invention are not limited to the display of sunglasses and that it can be applied to the display of other commodities as well.

A BRIEF DESCRIPTION OF THE DRAWINGS

Figure 3:
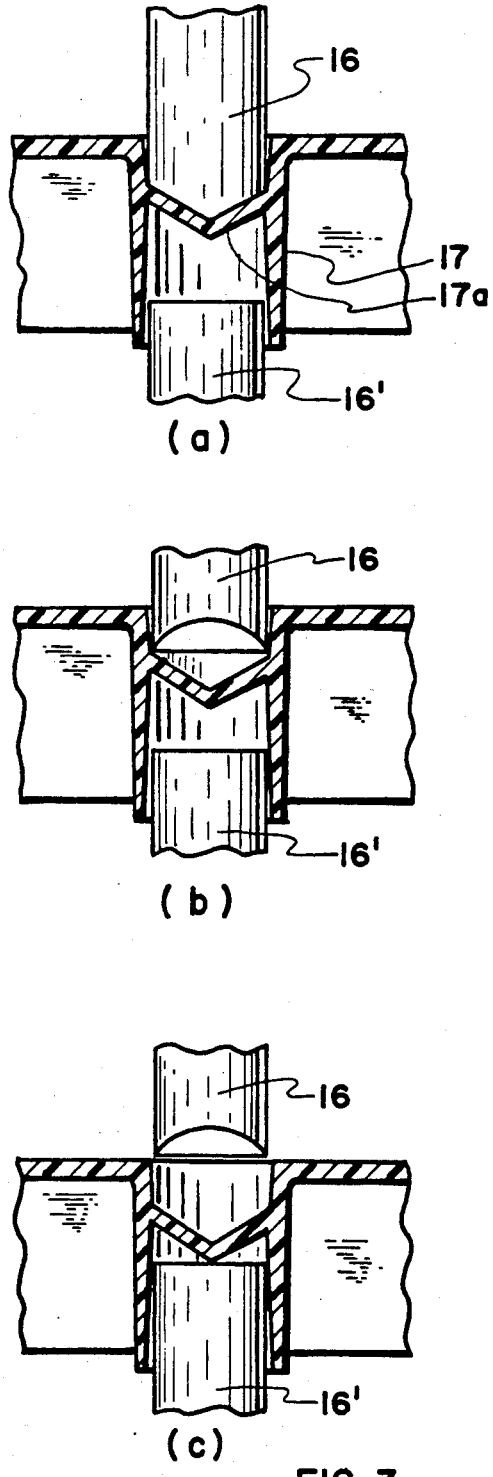

FIG. 3 depicts a cam device as a part of a preferred embodiment of this invention, said cam device being constituted by the lower end of a lower vertical shaft extending from the bottom portion of a column and a means provided in the column support device, said means being adapted to mate with said lower end of the lower vertical shaft. FIG. 3 also shows how said lower vertical shaft and an upper vertical shaft extending from the top of a column are supported by vertical holes provided in the column support device and how they can be slid along the vertical direction during the time when the display column is mounted onto the column support device or removed therefrom.

Figure 4:
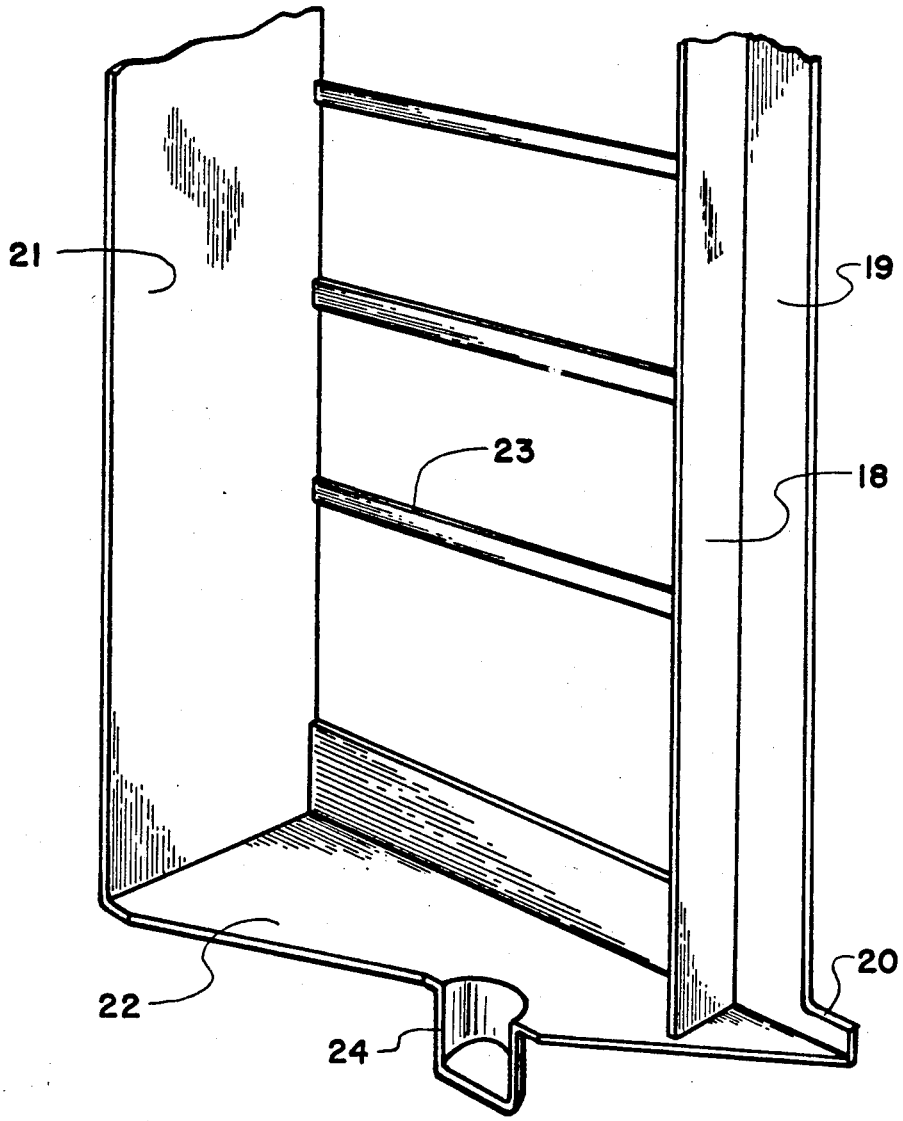

FIG. 4 depicts a preferred example of a twin part constituting half of the box-like outer part of the display column according to this invention.

Figure 5:
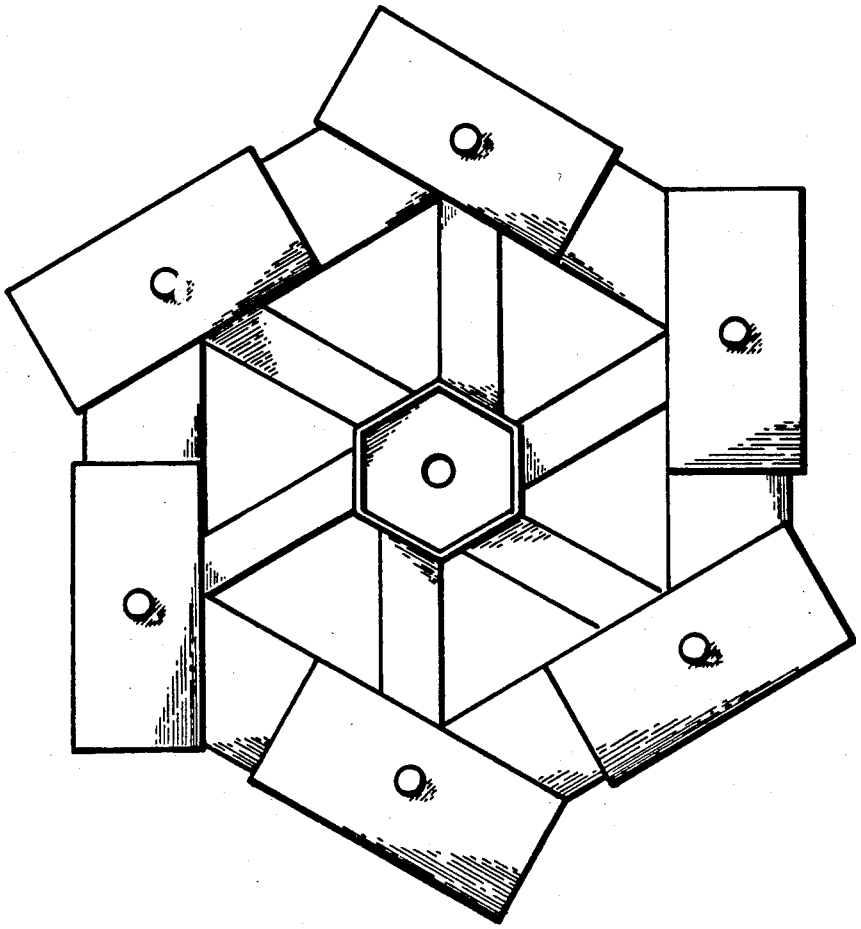

FIG. 5 depicts a preferred example of how a plurality of display columns are arranged in the supporting device at their rest positions.

DETAILED DESCRIPTION OF THE INVENTION

The commodity display device of this invention comprises one or more two-sided columns each of which comprising a box-like outer part comprising twin parts, an S-shaped column insert adapted to be positioned inside said box-like outer part and a column support device adapted to rotatably support said one or more columns in one or more levels and reposition said one or more columns to predetermined positions at rest.

In order to facilitate the understanding of this invention, it will first be described with reference to a preferred embodiment of the invention. Needless to say, the preferred embodiment is described for the purpose of illustrating the invention and the scope of this invention is limited only by the appended claims.

Figure 1:
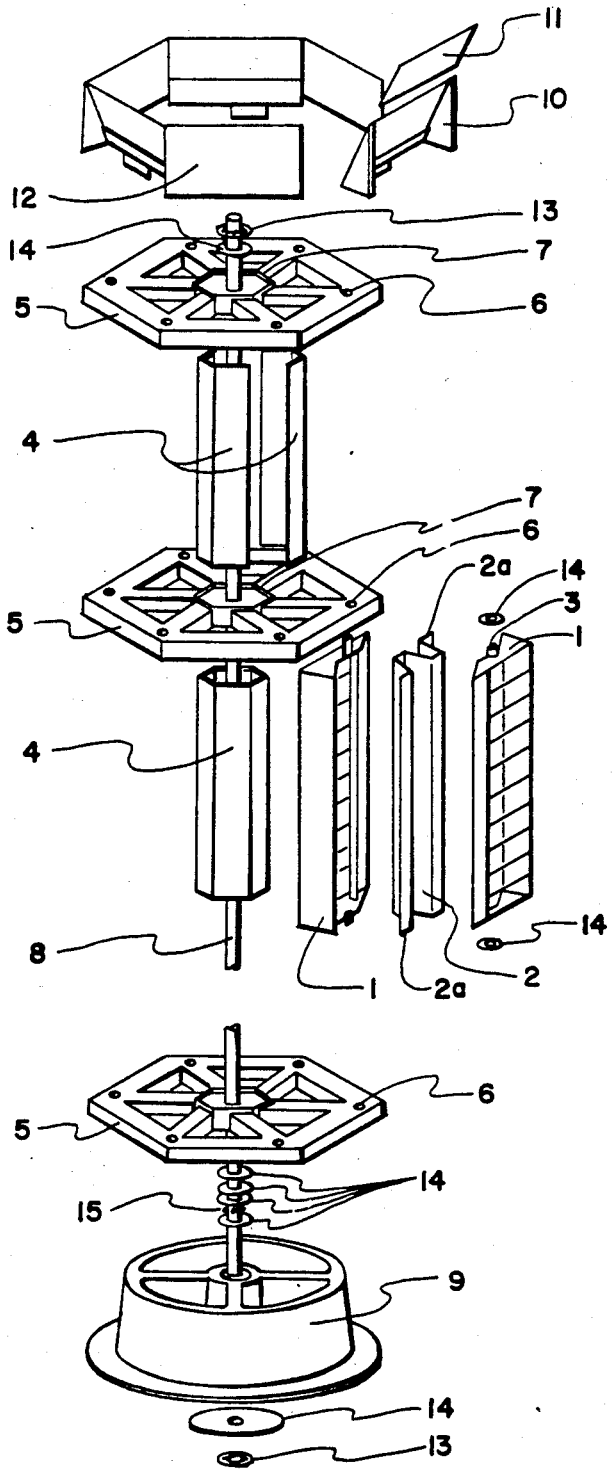
FIG. 1 is an exploded view of a preferred embodiment of the commodity display device according to this invention (including certain members which are not part of this invention).

FIG. 1 is an exploded view of a preferred example of the commodity display device according to this invention. It should be noted, however, that FIG. 1 includes various members which are not part of this invention as defined by the appended claims. Referring to FIG. 1, 1 is a twin part of the box-like outer part of a two-sided rotatable column, 2 is an S-shaped column insert, 3 is a vertical shaft extending from the top or bottom portion of the column, 4 is a spacer, 5 is referred to as a spider in this invention, 6 is a means for mating with the end portions of said vertical shafts 3, 7 is a protrusion provided in said spider 5 which accommodates the spacer 4 by engaging the outer perimeter of said spacer 4 with the inner part of the protrusion, 8 is a vertical pole, 9 is a base, 10 is a mirror holder, 11 is a mirror, 12 is a card header, 13 is a lock washer, 14 is a washer and 15 is a crimp provided in the vertical pole 8.

As evident from the above, each two-sided rotatable column comprises said twin parts 1 and column-insert 2, and in a preferred embodiment, upper and lower vertical shafts 3 extend from the top and bottom portions of each column. the term "two-sided" signifies that said column has two faces, namely the front and back faces, both of which being adapted for displaying commodities such as sunglasses.

As indicated above, the outer part of the column comprises twin parts such that when they are combined together, they form a box-like configuration. the term "box-like" as used in this specification and the appended claims shall mean any configuration adapted to accommodate commodities such as sunglasses. It does not necessarily mean that the configuration is defined by flat planes, straight edges and corners, the only essential requirement being that the box-like configuration have an inside space which is suitable for the display of commodities such as sunglasses. The front and back faces of the column have a pluralilty of horizontal retaining means which provide support for the commodities to be displayed, but are substantially open except for the horizontal retaining means. Said "horizontal retaining means" as used in this specification and the appended claims shall mean any horizontal member provided on the front or the back face of said column which is suitable for supporting sunglasses with temples open. Typically it is a horizontal bar extending across substantially the entire width of the front or the back face of the column, but it need not be such a single horizontal bar but instead, for instance, it may consist of two shorter horizontal bars extending half way from the extreme left and right end portions of the front or the back face of the column. The vertical distance between adjacent horizontal retaining means should be suitable for displaying commodities such as sunglasses in an esthetic manner without much loss of display space.

It is not essential, albeit preferable, that said twin parts be identical to each other. Thus, the term "twin parts" of the box-like outer part of the column as used in the specification and the appended claims shall mean two complementary parts which can be combined together to form a box-like outer part of the column. Any conventional means may be used to hold together said twin parts. For example, when the twin parts are identical to each other and each twin half has half cylinders extending from the top and bottom portions thereof, they can easily be assembled and held together by placing snap-on washers on the upper and lower vertical shafts formed from the half cylinders. An example of such twin parts is shown in FIG. 1.

Figure 2:
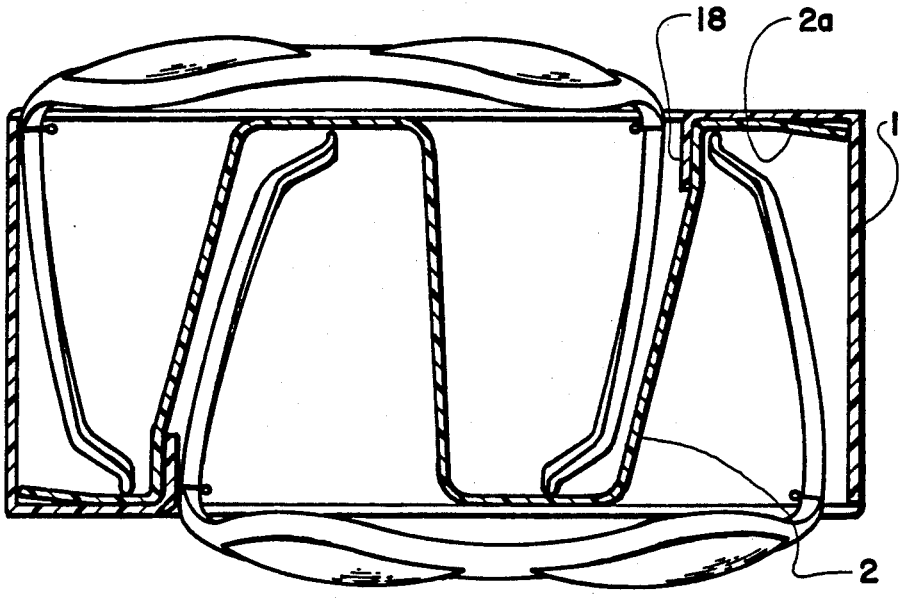
FIG. 2 depicts a typical manner in which two pairs of sunglasses are displayed with the temple portions opened in a staggered configuration on a given row of a two-sided rotatable column according to this invention.

FIG. 2 depicts a horizontal cross-sectional view of a preferred column according to this invention. It shows twin outer parts 1 and an S-shaped column insert 2. FIG. 2 also depicts how sunglasses are displayed in a staggered configuration with temples extended.

The afore-mentioned S-shaped column insert is placed between the twin parts of said column when they are assembled together and maintained in a substantially rigidly fixed manner. An example of such S-shaped column insert is shown in FIG. 1 and in more detail in FIG. 2. The S-shaped column insert as depicted in FIGS. 1 and 2 provides two furrows and a ridge for each of the front and back faces of the column such that sunglass frames displayed on the front face with the temples extended are staggered with respect to those displayed on the back face of the column. This arrangement allows the column to hold sunglasses on both faces but the depth of the column is substantially the same as the depth required for displaying a single pair of sunglasses, thus considerably saving the display space. Although the example of column insert shown in FIGS. 1 and 2 has two ridges and hence accommodates a single pair of sunglasses on each row of the front and the back faces of the column, it will be appreciated that one can also use a column insert having, for instance, a double or triple-S configuration. When the column insert has a double-S configuration having four ridges instead of two, two pairs of sunglasses can be displayed on each row of the front and back faces of the column. For the sake of convenience, the term "S-shaped" as used in the specification and the appended claims shall include not only single-S configuration, but also multiple-S configurations. Moreover, the term "S-shape" shall mean any sinusoidal configuration having two peak portions and two valley portions suitable for accommodating sunglasses with temples extended. A preferred example of said S-shaped configuration is shown in FIG. 2.

It is preferable that the column insert 2 have two flat edge portions 2*a* as shown in FIGS. 1 and 2 which adjoin the top and bottom curve portions of the S-shape structure.

It is prefereable to use an opaque material for the column insert in order to avoid a visual confusion between the sunglasses displayed on the front and the back faces of the column.

It is also preferable that one or more cam devices be provided in the commodity display device of this invention for the purpose of rotatably supporting each column and repositioning each column to predetermined positions at rest. A preferred example of such cam device is shown in FIG. 3. In FIG. 3, 16 is the lower portion of the lower vertical shaft 3 extending from the bottom portion of the column, 16' is the upper portion of the upper vertical shaft 3 extending from the top portion of the column, 17 is a vertical wall constituting a portion of the afore-mentioned spider 5, and 17*a* which is also a portion of spider 5 is a member having a V-shaped profile which matches with the V-shaped profile of the lower shaft 16. the vertical wall 17 and member 17*a* together constitute the afore-mentioned mating means 6. FIG. 3*a* depicts a rest position, FIG. 3*b* depicts a transient position where the column and hence the shaft 16 has been rotated around the vertical axis 90 degrees from the rest position, and FIG. 3*c* depicts a situation where the column has been pushed up from the rest position. As can be seen from FIG. 3, when the column is rotated around its vertical axis by the purchaser, the V-shaped edge of the lower shaft 16 rides up the crest provided in member 17*a*. When the column is released from a transient position such as depicted in FIG. 2*b*, it easily falls back to one of the two resting positions. The angle of the V-shape is such that it is not so acute as to hinder the rotation of the column by the purchaser but is sufficiently acute so that the column drops back easily from any transient position to the rest position by its own weight. Typically the V-shape makes an angle of about 35 degrees with respect to the horizontal plane. In a typical situation where the above-mentioned twin parts of the box-like outer part of the column are identical to each other, a half cylinder extending from the bottom portion of each twin part has a wedge-like profile at its end portion. It should be noted that the upper shaft extending from the top portion of the column need not have a V-shaped profile at the end. In fact, it is more convenient to have a flat edge. It will be seen from FIG. 3 that the lower portion of the vertical wall 17 supports the upper end portion of the upper shaft 16'. Removal of the column from the column support device can easily be accomplished by pushing up the column until the bottom shaft 16 clears the top of the vertical wall 17 and then swinging the column sideways. It will be appreciated that when the column is pushed up, the upper shaft 16' moves up along the lower vertical hole defined by the lower portion of the wall 17, but there is sufficient depth provided in the lower vertical hole so that the top of the upper shaft 16' does not touch member 17*a* when the column is swung sideways for removal from the column support device.

FIG. 4 depicts details of a preferred example of the twin part. In FIG. 4, 18 is an optional ridge provided in each twin part parallel to and a distance away from one of the vertical edges of the twin part, the distance being slightly larger than the width of said flat edge portion 2*a* of the column insert 2 so that said ridge 18 provides a support for the column insert 2 by preventing the movement thereof inside the column in the horizontal direction. When the twin parts and the column insert are assembled together, one of the afore-mentioned flat edge portions 2*a* of the column insert 2 rests against a narrow portion 19 indicated in FIG. 4.

It is preferable to have an indentation indicated by 20 in FIG. 4 at the edge portion of the face of the column. Said indentation provides an opening preferably along substantially the entire height of the column. By virtue of said indentation 20, a strip of cardboard paper, for instance, can be slid along the opening and placed between a narrow gap defined by said portion 19 and the flat edge portion 2*a* of the column insert 2. Said cardboard paper typically has promotional information printed thereon which is useful for the sale of the merchandise displayed in the column.

Again referring to FIG. 4, 21 is the vertical side portion of the twin part which is usually a flat wall having no openings. 22 is the bottom side of the twin part, 23 is a horizontal bar which is an example of the afore-mentioned horizontal retaining means, and 24 is a half cylinder having a wedge structure at its end. Spacings between adjacent horizontal bars 23 should be suitable to display commodities such as sunglasses in a suitable and esthetic manner. In the case of sunglass display, each horizontal bar 23 makes contact with portions of the sunglass frame where the front portion of the frame and the temples are joined. Usually, the weight distribution of a pair of sunglasses is such that the end portions of the extended temples lean slightly against the furrow parts of the column insert. In a typical display, one of the temples, for instance, the left temple, is a short distance away from the vertical side wall 21 and the other temple is a short distance away from one of the bottom curves of the S-shaped column insert and hence there is not much room for the horizontal movement of the sunglass frame and consequently all the sunglass frames displayed on a given face of a column are uniformly aligned with respect to each other without being aided by any conscious effort made by the retailer or the purchaser to align them uniformly. The distance between the front (or back) face of the column and the vertical curve portion of the S-shaped column insert (which is substantially the same as the depth of the afore-mentioned furrow) determines the angle which the temples make with respect to the front or the back face of the column when the sunglasses are displayed with temples extended. Typically, the depth of the furrow is such that said angle becomes about 45 degrees.

Typically, each twin part 1 of the box-like outer part of the column is molded from a transparent plastic material using a conventional molding technique. Thus, said horizontal retaining means such as horizontal bars 23 provided on the front face of said twin part 1 can be molded as a part of a single molded piece. Usually, said vertical shafts 3 are also a part of a unified molded piece.

Said S-shaped column insert 2 is usually molded from an opaque plastic material by use of a conventional molding technique. The opaqueness of the column insert 2 prevents visual confusion between sunglasses displayed on the front face of the column and those displayed on the back face of the column. The S-shaped configuration of the column insert 2 allows a staggered arrangement of the sunglass frames with temples extended and saves a considerable amount of display space. The twin parts 1 of the box-like outer part of the column and the column insert 2 are assembled, for instance, simply by use of a pair of washers 14 placed on the upper and the lower shafts 3. When said items are assembled, a box-like display column is formed having a front and back faces which are substantially open. The two vertical side portions of the column can be utilized, for instance, for mounting cardboard papers having promotional information printed thereon. Said horizontal retaining means, for instance, horizontal bars may also be utilized to support some other articles on which certain merchandises such as clip-on sunglass lenses may be displayed. Said horizontal retaining means, in concert with the column insert 2, are sufficient to support sunglass frames in a stable manner.

The spacer 4 is usually made of twin parts. Typically the twin parts of the spacer 4 are molded from a plastic material using a conventional molding technique. Spacer 4 has the effect of locking the relative position of two adjacent spiders. Namely, spacer 4 prevents twisting of a spider with respect to another spider. The spacer 4 provides a suitable spacing between the adjacent spiders 5 such that the columns may be supported in a stable manner between the spiders. The spacing between the adjacent spiders 5 should be such that installation and removal of the column as assembled to and from the column support device can be accomplished easily by lifting the column with respect to the spider 5 until the lower end of the lower vertical shaft 3 clears the level of the lower spider 5 of the adjacent pair. The twin parts of the spacer 4 are slid inside the vertical protrusions 7. This engagement is carried out both at the upper and lower ends of the spacer 4 by use of the protrusions 7 provided on the upper and the lower spiders 5. The term "upper and lower spiders 5" is used in a relative sense in that it refers to two adjacent spiders provided in the supporting device, one of them being upper spider and the other being lower spider. Thus, when there are three or more spiders 5 in the column support device, a given spider can be a lower spider with respect to one spider but also an upper spider with respect to another spider. The spider 5 is typically molded from a plastic material using a conventional molding technique. In such a case, the afore-mentioned vertical protrusions 7 are molded as a part of a unified molded piece.

The number of levels of display columns can be adjusted simply by varying the number of spacers and spiders and by adjusting the height of the vertical pole 8. Each spider has the same number of mating means 6 as the number of display columns provided in a given level. FIG. 5 shows an example of how the individual display columns are oriented at their rest positions. FIG. 5 represents a preferred situation where six display columns are provided in a given level. The six mating means are provided in the same spider in such orientations that each of the six display columns take a coherent and esthetic orientation with respect to others at the rest position as shown in FIG. 5. It will be noticed that the front and the back faces of each column are parallel to one of the hexagonal edges of the spider. In this orientation the purchaser can see one of the temples of each sunglass frame displayed as well as the front portion thereof. This is particularly true where the column insert 2 has a single-S configuration. Where the column insert 2 has a multiple-S configuration, temples of sunglasses become less visible except for one pair of sunglasses displayed on each row of the front or back face of the column.

In a typical situation, a mirror holder 10 is provided at the top portion of the supporting device into which the mirror 11 can be slid. A card header 12 is provided between two adjacent mirror holders. Said headeris usually a promotional material.

In a preferred embodiment, the vertical pole 8 is locked to the base 9 and does not rotate, but the spiders 5 are made rotatable around the vertical pole 8 by the purchaser and, of course, each individual display column can be rotated around its vertical axis. Alternatively, the vertical pole 8 may be made rotatable within the base 9 and the spiders 5 rigidly fixed to the vertical pole 8.

The present invention has been described above with reference to a preferred embodiment with particular emphasis on the display of sunglasses. However, the instant invention is limited only by the following claims.

It will be appreciated by the person skilled in the art that it is not essential that upper and lower vertical shafts extend from the top and bottom portions of each column. Thus, the aforementioned purpose of rotatably supporting each column and repositioning each column at predetermined position at rest can be accomplished by reversing the roles played by members 16, 16', 17 and **17*a*** in the the preferred embodiment described above. Thus, for instance, instead of providing vertical shafts extending from the column, one can provide vertical shafts extending from suitable locations in the spiders and provide vertical holes in each column which are suitable for mating with said vertical shafts provided in the spiders. One can use any combinations of such vertical shaft/vertical hole combination. Namely, for instance, one can provide a vertical lower shaft extending from the bottom portion of each column and a vertical hole at the top portion of each column and vertical holes and vertical shafts at appropriate locations of the spiders in such a manner that the aforementioned purpose can be accomplished.

We claim:

1. A commodity display device comprising one or more two-sided columns each of which comprising a box-like outer part having substantially open front and back faces, a vertical column insert having an S-shaped horizontal cross-section adapted to be positioned inside said box-like outer part; a column support device adapted to rotatably support said one or more columns in one or more levels and reposition said one or more columns to predetermined positions at rest, each of said columns having a plurality of horizontal retaining means on the front and back faces thereof which are substantially open, and each of said retaining means being adapted to retain one or more commodities thereon.

2. The commodity display device as defined in claim 1, wherein said column insert has a single-S shape.

3. The commodity display device as defined in claim 1, wherein said column insert is made of an opaque material.

4. The commodity display device as defined in claim 1, wherein said box-like outer part is made of a substantially transparent material.

5. The commodity display device as defined in claim 1, wherein said box-like outer part comprises twin parts that are substantially identical to each other.

6. The commodity display device as defined in claim 1, wherein said column insert has flat edge portions at each end of the S shape.

7. The commodity display device as defined in claim 6, wherein a ridge is provided in each of said twin parts parallel to and a distance away from one of the vertical edges of said twin part, the distance being slightly larger than the width of said flat edge portion of the column insert so that said ridge provides a support for the column insert by preventing the movement thereof inside the column in the horizontal direction.

8. The commodity display device as defined in claim 1, wherein said column support device is adapted to accommodate said columns in two levels.

9. The commodity display device as defined in claim 1 which comprises a plurality of said columns.

10. The commodity display device as defined in claim 1, wherein said column support device is adapted to accommodate six of said columns in a given level.

11. The commodity display device as defined in claim 1 wherein each of said one or more columns comprises upper and lower vertical shafts extending from the top and bottom portions, respectively. of said box-like outer part and said column support device comprises means adapted for mating with said upper and lower vertical shafts.

12. The commodity display device as defined in claim 11, wherein said column insert has a single-S shape.

13. The commodity display device as defined in claim 11, wherein said column insert is made of an opaque material.

14. The commodity display device as defined in claim 11, wherein said box-like outer part is made of a substantially transparent material.

15. The commodity display device as defined in claim 11, wherein said box-like outer part comprises twin parts that are substantially identical to each other.

16. The commodity display device as defined in claim 11, wherein said column insert has flat edge portions at each end of the S shape.

17. The commodity display device as defined in claim 16, wherein a ridge is provided in each of said twin parts parallel to and a distance away from one of the vertical edges of said twin part, the distance being slightly larger than the width of said flat edge portion of the column insert so that said ridge provides a support for the column insert by preventing the movement thereof inside the column in the horizontal direction.

18. The commodity display device as defined in claim 11, wherein said column support device is adapted to accommodate said columns in two levels.

19. The commodity display device as defined in claim 11 which comprises a plurality of said columns.

20. The commodity display device as defined in claim 11, wherein said column support device is adapted to accommodate six columns in a given level.

21. The commodity display device as defined in claim 11, wherein a V-shaped profile is provided at the end of each lower shaft and a matching V-shaped profile is provided in said mating means of said column support device.

22. The commodity display device as defined in claim 21, wherein said column insert has a single-S shape.

23. The commodity display device as defined in claim 21, wherein said column insert is made of an opaque material.

24. The commodity display device as defined in claim 21, wherein said box-like outer part is made of a substantially transparent material.

25. The commodity display device as defined in claim 21, wherein said box-like outer part comprises twin parts that are substantially identical to each other.

26. The commodity display device as defined in claim 21, wherein said column insert has flat edge portions at each end of the S shape.

27. The commodity display device as defined in claim 26, wherein a ridge is provided in each of said twin parts parallel to and a distance away from one of the vertical edges of said twin part, the distance being slightly larger than the width of said flat edge portion of the column insert so that said ridge provides a support for the column insert by preventing the movement thereof inside the column in the horizontal direction.

28. The commodity display device as defined in claim 21, wherein said column support device is adapted to accommodate said columns in two levels.

29. The commodity display device as defined in claim 21 which comprises a plurality of said columns.

30. The commodity display device as defined in claim 21, wherein said column support device is adapted to accommodate six of said columns in a given level.

* * * * *